US006659273B1

(12) United States Patent
Scola

(10) Patent No.: US 6,659,273 B1
(45) Date of Patent: Dec. 9, 2003

(54) LAUNDRY TOTE

(76) Inventor: Vito A. Scola, 137 Apple Gate Rd., Cranston, RI (US) 02920

( * ) Notice: Subject to any disclaimer, the term of this patent is extended or adjusted under 35 U.S.C. 154(b) by 0 days.

(21) Appl. No.: 10/218,347

(22) Filed: Aug. 14, 2002

(51) Int. Cl.[7] ..... B65D 85/18
(52) U.S. Cl. ..... 206/285; 206/287; 206/288
(58) Field of Search ..... 206/284, 286, 206/287, 287.1, 288, 289, 290, 291, 736, 806; 190/110, 111; 232/1 B; 211/113, 118; 312/6, 321

(56) References Cited

U.S. PATENT DOCUMENTS 2,490,222 A 12/1949 Lowe
2,517,757 A 8/1950 Adlerstein
2,534,380 A * 12/1950 Schwartzman ..... 206/287
2,645,541 A * 7/1953 Mintz et al. ..... 206/287
3,299,997 A * 1/1967 Herz ..... 206/289
3,958,675 A * 5/1976 Rosenblum ..... 206/287.1
4,094,351 A 6/1978 Catenaccio
4,193,482 A * 3/1980 Koff ..... 206/287
4,739,880 A 4/1988 Sawyer et al.
4,773,585 A 9/1988 Lehrman
4,887,700 A * 12/1989 Rice ..... 190/111
5,050,998 A 9/1991 Wachtel
5,503,476 A 4/1996 Hamdan
5,735,608 A 4/1998 Branco
6,109,403 A * 8/2000 Godshaw ..... 206/290
6,126,054 A 10/2000 Riemer
6,302,281 B1 * 10/2001 Wang ..... 206/287

* cited by examiner

*Primary Examiner*—Luan K. Bui
(74) *Attorney, Agent, or Firm*—Salter & Michaelson

(57) ABSTRACT

A laundry tote including at least one rotatable support member for hanging the tote is disclosed. The tote may also include a cover which can be secured over the top to prevent laundry from inadvertently falling out of the tote, and may include a pocket for receiving a label or the like for identification purposes.

20 Claims, 5 Drawing Sheets

LAUNDRY TOTE

TECHNICAL FIELD

The invention relates generally to laundry bags, and more particularly to a tote for holding and transporting laundry.

BACKGROUND OF THE RELATED ART

Various devices for holding and transporting laundry are well known in the art. These laundry totes, bags and/or hampers take any of a number of forms, including for example the devices disclosed in U.S. Pat. No. 5,735,608 to Branco, U.S. Pat. No. 4,773,585 to Lehrman, and U.S. Pat. No. 5,503,476 to Hamdan.

All of the laundry bags disclosed in the above-identified patents are designed to hold and transport laundry, for example to a Laundromat or dry cleaner. The Branco patent discloses a laundry bag which has a portable "hamper-like" configuration. The bag includes a base which allows the bag to sit in a hamper-like fashion on the floor, a zippered opening in the top to deposit laundry, a zipper on the side of the bag for removal of the laundry and transfer to a washing machine, and a strap to carry the bag. The Branco device further includes a plurality of support members which maintain the bag in the shape of the hamper during use. The support members, or rods, may be removed to launder the bag.

The Lehrman patent discloses a laundry bag which may, likewise, be used as a "clothes hamper" and which is suspended from a removable hanger and frame, which frames the bag opening during use as a hamper. The hanger and frame can be removed when the bag is full, and the bag includes a drawcord to permit closure of the top of the bag once the hanger is removed, in order to facilitate transport of the bag to a Laundromat, or the like. The bag may also be partitioned to separate the clothes within the bag, and may include a zippered bottom to facilitate removal of soiled laundry from the bag.

The Hamdan patent discloses a bag designed to presort laundry prior to washing. The bag preferably includes a pair of interior compartments defined by a separation panel. A closure apparatus 60, including a closure strap 66 may be provided for closing rear panel 62 over entrance aperture 20 of compartments 14 and 16. The closure panel includes an opening for hanging the bag, or a hanger can be received in loops attached to the bag for hanging. The bag also preferably includes a plurality of pockets for holding laundry related items.

While laundry bags of the aforementioned type are useful in holding and transporting laundry, they do not always do so in the most convenient or secure manner. In addition, some of the devices are relatively complex in their design both in terms of manufacture and use. Therefore, there is a continued need in the art for a laundry bag which can hold and transport laundry in a convenient manner, while being easy to use and manufacture.

SUMMARY

It is an object of the laundry tote disclosed herein to provide a device which can be used to hold and transport laundry in a convenient manner, which is simple in both construction and use, and which securely holds laundry therein, even when full. The tote also preferably includes at least one rotatable support member for hanging the tote, if desired. The support member is rotatably supported such that they may be enclosed within the bag when not in use, and thereafter rotated to engage a support member, for example a rod. In one embodiment, the tote further includes a bottom or base, a pair of side walls, a front wall, a back wall and an opening defined by the upper edges of the walls, through which laundry is deposited and removed. In this embodiment, a pair of support members, or hangers, are supported adjacent the top edge of both the front and back walls for hanging the tote. The tote may also include a cover which can be secured over the top to prevent laundry from inadvertently falling out of the tote, and a pocket for receiving a label or the like for identification purposes.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
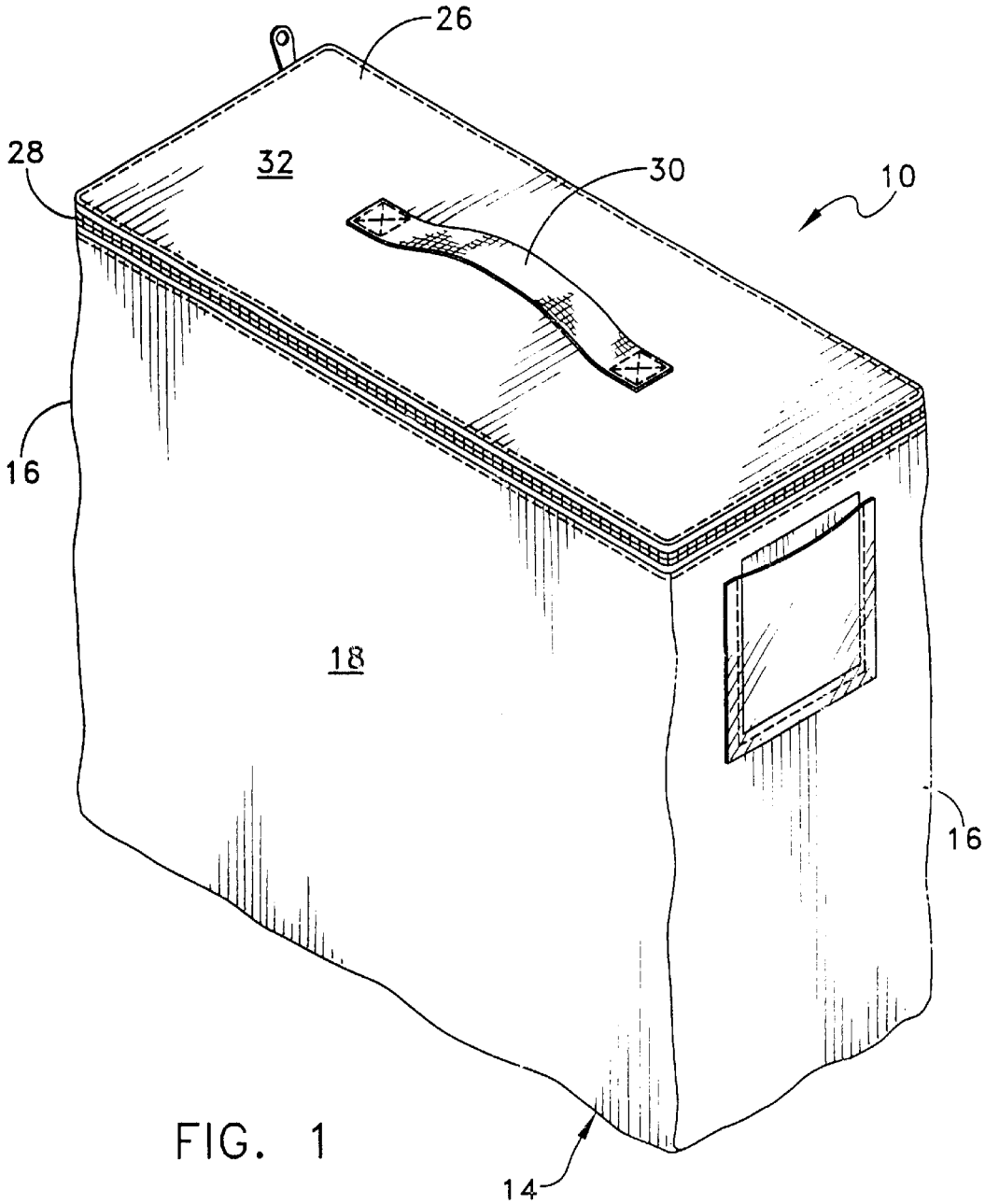
FIG. 1 is a perspective view of the laundry tote of the present invention in a closed position.
Figure 2:
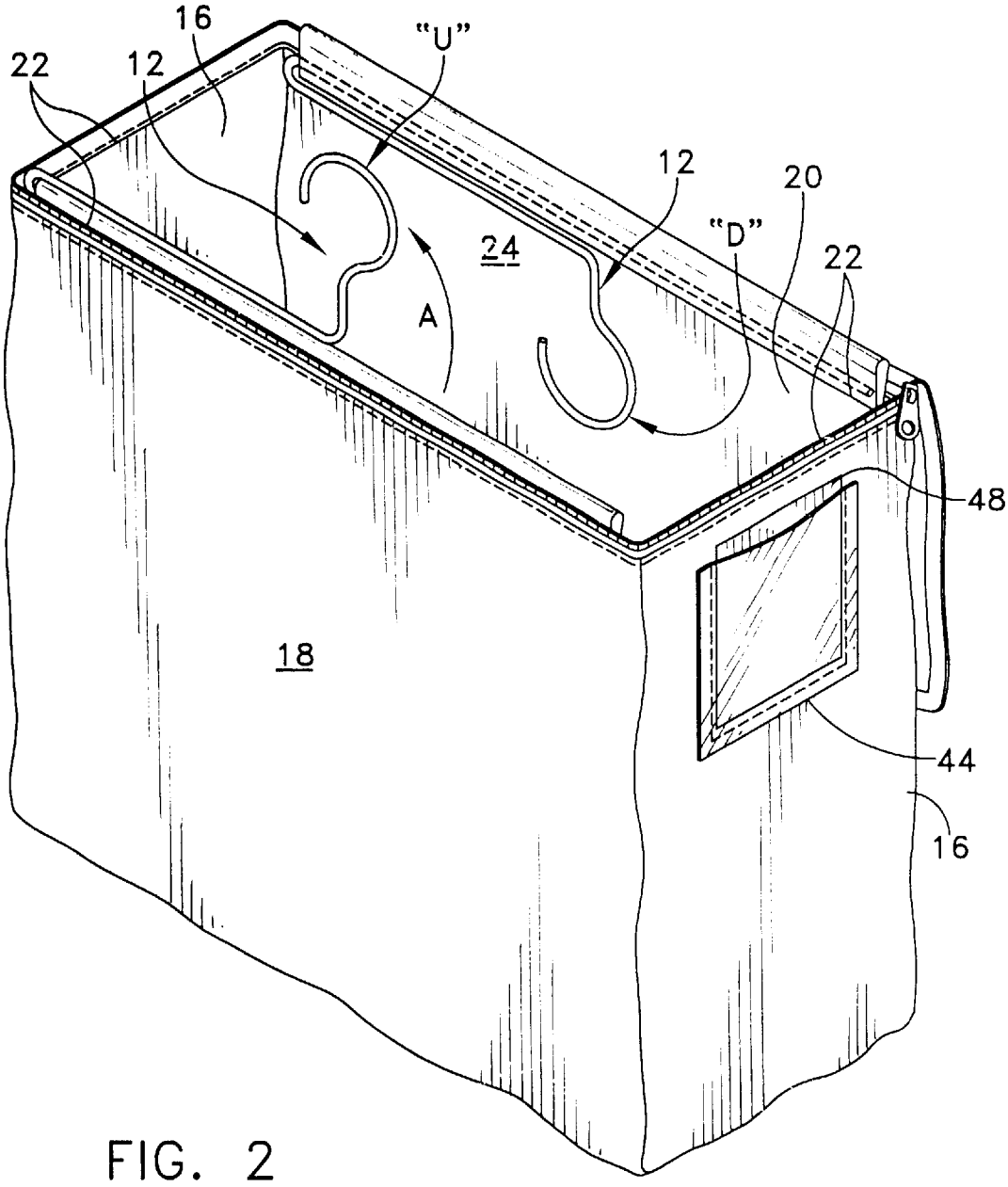
FIG. 2 is a perspective view of the tote of FIG. 1 in an open position.
Figure 3:
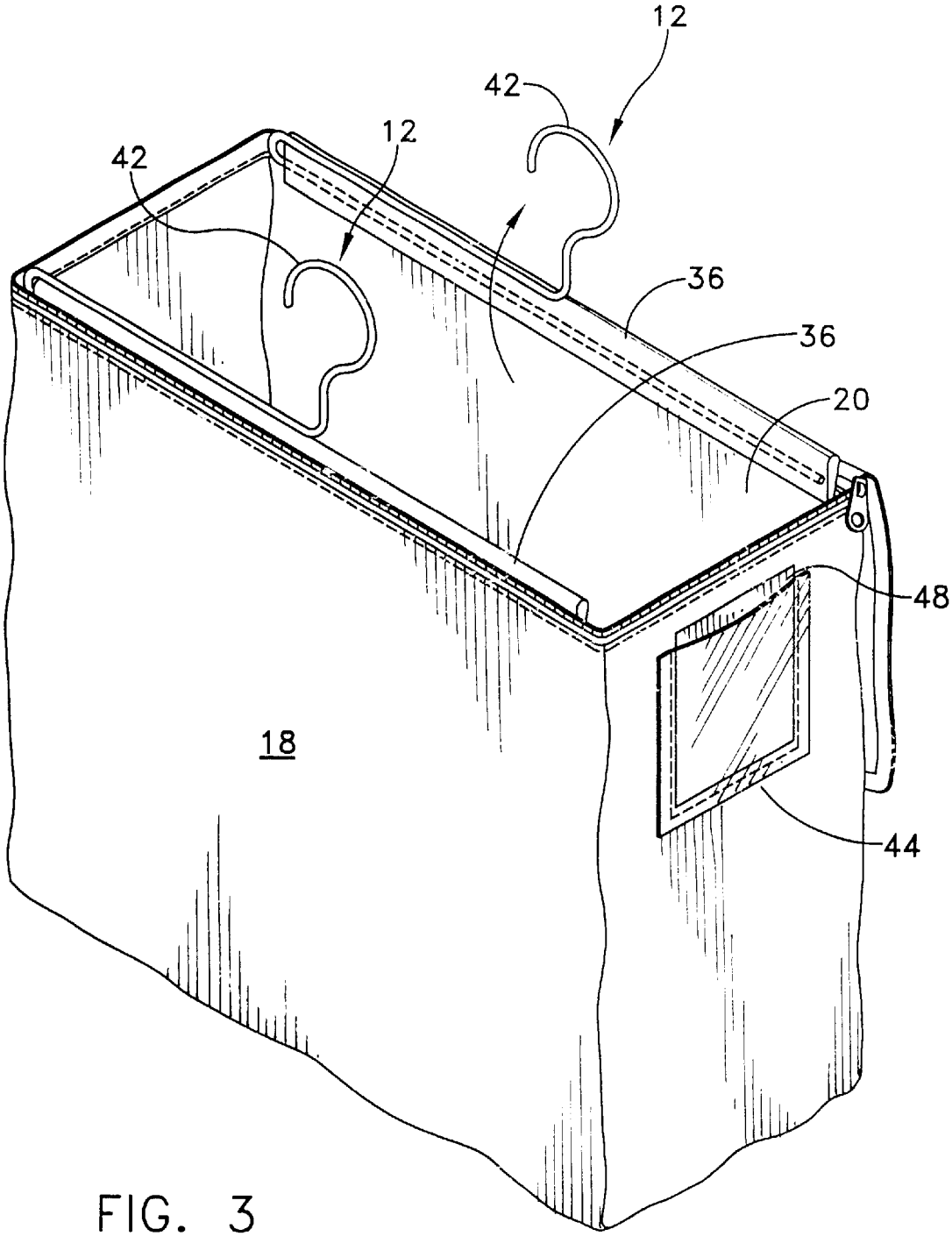
FIG. 3 is a perspective view of the tote of FIG. 1 in an open position and ready for hanging.

Referring now to FIGS. 1–6, a tote 10 designed to hold and transport laundry and including at least one support member 12 for hanging the tote is illustrated. The tote 10 also preferably includes a bottom 14, and at least one wall having a lower edge adjacent the bottom and an opposite, upper edge. In the present embodiment, the tote preferably has a rectangular shape and includes a pair of end or side walls 16, a front wall 18, and a back wall 20, as illustrated. The side walls, front wall and back wall all include an upper edge 22 which defines an opening through which laundry may be deposited into an interior cavity 24 of the tote 10 and removed therefrom. Alternatively other shapes may be utilized, for example cylindrical, as would be known to those of skill in the art. In such a case, the side walls, front and back wall would be replaced by a single wall. A cover 26 is also preferably provided to cover the opening of the bag in order to secure the laundry within cavity 24, for example during travel. The cover 26 may be secured over the opening in any known manner, for example by snaps, Velcro® material, or the like. In the present embodiment, a zipper 28 is used to secure the cover in a closed position over the opening. A strap, or handle 30 may be supported on an outer surface 32 of the cover in order to facilitate moving the tote. The handle may, alternatively, be supported on the side walls 16 of the tote in the form of a shoulder strap (not shown), as would be known in the art.

Figure 4:
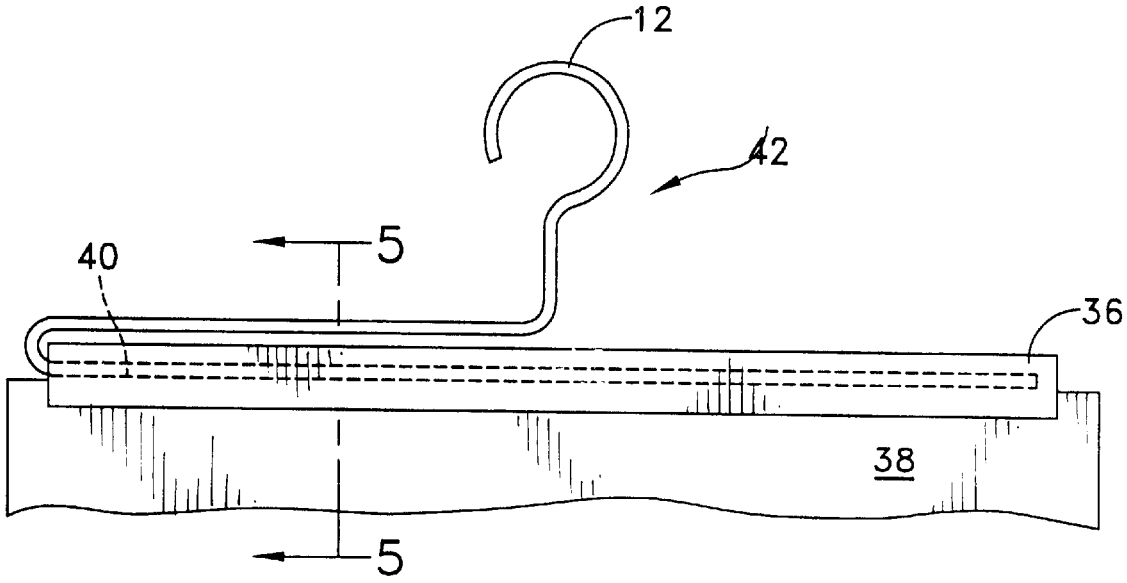
FIG. 4 is a side view of the hanger of FIG. 3.
Figure 5:
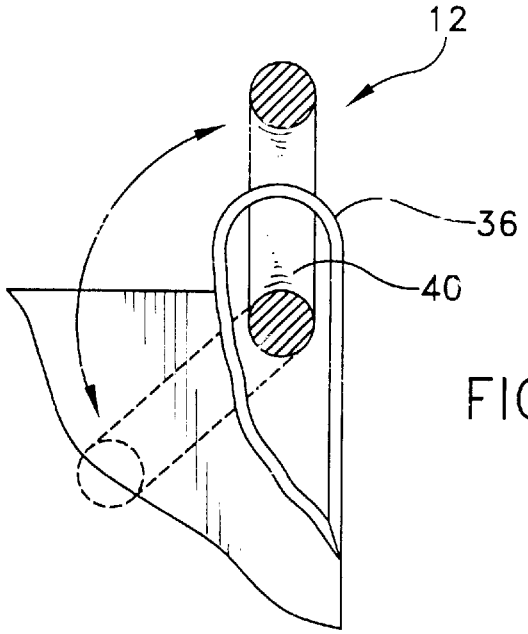
FIG. 5 is a cross sectional view taken along lines 5—5 of FIG. 4.
Figure 6:
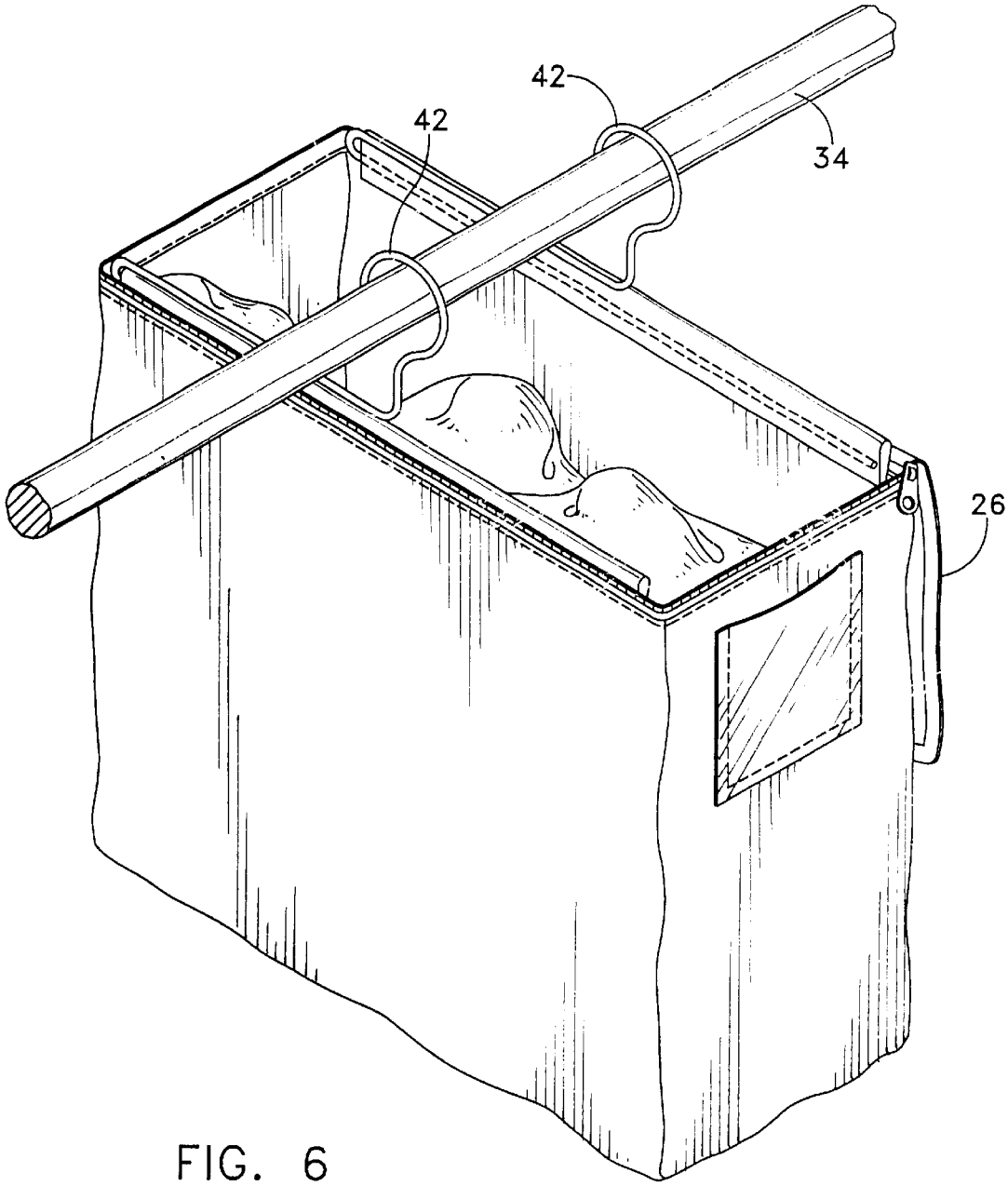
FIG. 6 is a perspective view of the tote of FIG. 1 in an open and hung position.

Referring now to FIGS. 2–6, the tote 10 further includes at least one support member 12 pivotally or rotatably supported on the tote for hanging the tote from a support member such as rod 34, as desired. For example, the tote may be hung in a closet when being filled with soiled laundry, or may be hung while at a Laundromat. In the present embodiment, the at least one support member 12 includes a pair of hangers supported for rotation adjacent the upper edge of both the front wall 18 and back wall 20. As best shown in FIGS. 4 and 5, a sleeve 36 may be supported on an inner surface 38 of each of the front and back walls for receiving an arm 40 of each hanger. The arm 40 extends from within the sleeve and terminates in an engagement member, for example a hook 42, in the present embodiment. The arms 40 of each hanger are inserted within their corresponding sleeve 36 such that the arms are rotatable within the sleeves in order to move the hooks 42 from a first, non-engaged position where the hangers are positioned downward ("D" FIG. 2) and are substantially disposed within the interior cavity so that they may be enclosed within the bag. The hanger may thereafter be rotated in the direction of arrow "A" to a second, upward position ("U" FIG. 2) such that a portion of the hangers extend from within the cavity 24, and beyond the upper edge 22, so that they may engage the support member for example rod 34 (FIG. 6). The sleeves may be secured to the interior of the tote in any known manner, for example, by stitching, and may extend along substantially the length of the front and back walls. Although a pair of sleeves are illustrated, other devices for rotatably supporting the arms may be utilized, for example one or more straps. By positioning a pair of support members 12 adjacent the upper edge of both the front and back walls, the hangers are substantially parallel to each other and the tote can be hung such that the opening is fully accessible and the bottom of the tote remains substantially flat while being filled.

The tote may further include a pocket 44 for receiving a label 48 therein for identification purposes. The pocket may preferably be transparent and the label is preferably removable. Dividers (not shown) may also be provided within the interior cavity 24 for sorting clothes, as is known in the art. Other features may also be included on the bag, for example outer pockets for holding laundry items, as also known in the art.

Use of the laundry tote 10 will now be described with reference to FIGS. 1–6. In use, the cover 26 is opened and the support members 12 may be rotated into the upward position and hung from a rod, for example a closet rod, as shown in FIG. 6. In this position the opening 23 is fully open and ready to receive soiled laundry. When the user is ready to have his or her clothes washed, the support members 14 are rotated into the downward position, such that they extend below the upper edge 22 of the tote. When the support members are in this position, the cover may be positioned over the opening and secured, for example by closing the zipper (FIG. 1). Once the cover is secured, the tote may be carried to its destination by the handle 30. The cover may thereafter be opened, the support members rotated back into their upward position, and the tote may be again hung from a support.

As will be appreciated, the laundry tote disclosed herein may be used to hold and transport laundry in a convenient manner, is simple in both construction and use, and securely holds laundry therein, even when full.

It will be understood that various modifications may be made to the embodiment disclosed herein. For example, the size and shape of the bag may be varied, as would be known to those of skill in the art. Also, the cover may or may not be provided, and the cover may be removable from the bag. In addition, other features may be included within the basic design of the bag having rotatable support members, as known in the art. Therefore, the above description should not be construed as limiting, but merely as exemplifications of a preferred embodiment. Those skilled in the art will envision other modifications within the scope, spirit and intent of the invention.

What is claimed is:

1. A tote for receiving and transporting laundry comprising:

a bottom;

at least one wall including a lower edge adjacent the bottom and an opposing, upper edge defining an opening, the at least one wall and bottom together defining an interior cavity constructed and arranged to receive laundry through the opening;

a pair of support members rotatably supported on an inner surface adjacent the upper edge such that the opening is disposed between the pair of support members, the pair of support members each including an engagement member constructed and arranged to engage a support structure; and wherein the pair of support members are rotatable between a first position wherein the pair of support members are disposed within the interior cavity to a second position wherein the engagement member of the pair of support members extends from within the interior cavity, and beyond the upper edge, such that the pair of support members may engage the support structure, and wherein upon engagement with the support structure the opening is positioned between the pair of support members such that laundry may be received through the opening and supported within the bag.

2. The tote of claim 1, wherein the pair of support members comprise a pair of hangers, each of the pair of hangers having an arm rotatably supported on the bag.

3. The tote of claim 1, wherein the at least one wall includes a pair of side walls, a front wall and a back wall.

4. The tote of claim 3, wherein the pair of hangers comprise a first and a second hanger, the first hanger being supported adjacent the upper edge of the front wall, and the second hanger being supported adjacent an upper edge of the back wall.

5. The tote of claim 2, wherein the engagement member comprises a hook.

6. The tote of claim 2, further comprising a sleeve member for each the pair of hangers, the sleeve member being supported on the inner surface of the tote and being configured and dimensioned to rotatably receive the arm of one of the pair of hangers.

7. The tote of claim 1, further comprising a cover constructed and arranged to substantially cover the opening in a closed position.

8. The tote of claim 1, further comprising a strap engageable by a user.

9. The tote of claim 1, further comprising a pocket constructed and arranged to receive a label therein.

10. A tote for receiving and transporting laundry comprising:

a bottom;

at least one wall including a lower edge adjacent the bottom and an opposing, upper edge defining an opening, the at least one wall and bottom together defining an interior cavity constructed and arranged to receive laundry through the opening;

a pair of hangers each including an arm rotatably supported by the bag on an inner surface of the at least one wall adjacent the upper edge such that the opening is disposed between the pair of hangers, the pair of hangers each including an engagement member constructed and arranged to engage a support structure;

a sleeve member for each of the pair of hangers, each sleeve member being supported on the inner surface of the tote and being configured and dimensioned to rotatably receive the arm of the pair of hangers; and a cover constructed and arranged to substantially cover the opening in a closed position;

wherein the pair of hangers are rotatable between a first position wherein the pair of hangers are disposed within the interior cavity to a second position wherein the engagement member of the at least one or more hangers extends from within the interior cavity, and beyond the upper edge, such that the pair of hangers may engage the support structure, and wherein upon engagement with the support structure the opening is positioned between the pair of support members such that laundry may be received through the opening and supported on the bottom of the bag.

11. The tote of claim 10, wherein the at least one wall includes a pair of side walls, a front wall and a back wall.

12. The tote of claim 10, wherein the one or more hangers comprise a first and a second hanger, the first hanger being supported adjacent the upper edge of the front wall, and the second hanger being supported adjacent an upper edge of the back wall.

13. The tote of claim 10, wherein the engagement member comprises a hook.

14. The tote of claim 10, further comprising a strap engageable by a user.

15. The tote of claim 10, further comprising a pocket constructed and arranged to receive a label therein.

16. A tote for receiving and transporting laundry comprising:

a bottom;

at least one wall including a lower edge adjacent the bottom and an opposing, upper edge defining an opening, the at least one wall and bottom together defining an interior cavity constructed and arranged to receive laundry through the opening;

a pair of support members supported on an inner surface adjacent the upper edge such that the opening is disposed between the pair of support members, the pair of support members each including an engagement member constructed and arranged to engage a support structure; and wherein the pair of support members are movable between a first position wherein the pair of support members are disposed within the interior cavity to a second position wherein the engagement member of the pair of support members extends from within the interior cavity, and beyond the upper edge, such that the pair of support members may engage the support structure, and wherein upon engagement with the support structure the opening is positioned between the pair of support members such that laundry may be received through the opening and supported within the bag.

17. The tote of claim 16, wherein the pair of support members comprise a pair of hangers, each of the pair of hangers having an arm rotatably supported on the bag.

18. The tote of claim 16, wherein the one or more hangers comprise a first and a second hanger, the first hanger being supported adjacent the upper edge of the front wall, and the second hanger being supported adjacent an upper edge of the back wall.

19. The tote of claim 16, wherein the engagement member comprises a hook.

20. The tote of claim 17, further comprising a sleeve member for each the pair of hangers, each sleeve member being supported on the inner surface of the tote and being configured and dimensioned to rotatably receive the arm of the one of the pair of hangers.

* * * * *